US006935134B2

(12) United States Patent
Lahti et al.

(10) Patent No.: US 6,935,134 B2
(45) Date of Patent: Aug. 30, 2005

(54) METHOD AND KIT USED TO COOL BEVERAGES

(76) Inventors: Howard R. Lahti, 1158 Woodstock Road, Fredericton (CA); Daniel J. Boyd, 21 Sibley Ct., Jefferson, CO (US) 80456

( * ) Notice: Subject to any disclaimer, the term of this patent is extended or adjusted under 35 U.S.C. 154(b) by 0 days.

(21) Appl. No.: 10/723,461

(22) Filed: Nov. 26, 2003

(65) Prior Publication Data

US 2004/0148960 A1 Aug. 5, 2004

Related U.S. Application Data

(60) Provisional application No. 60/429,929, filed on Nov. 27, 2002.

(51) Int. Cl.[7] ..... F25D 3/08

(52) U.S. Cl. ..... 62/457.3; 62/114; 62/437; 62/457.2; 62/531; 426/524

(58) Field of Search ..... 62/530, 114, 437, 62/457.3, 531; 426/524; 165/4, 6, 10

(56) References Cited

U.S. PATENT DOCUMENTS

| | | | | | |
|---|---|---|---|---|---|
| 740,847 | A | | 10/1903 | Glebsattel | |
| 2,152,467 | A | * | 3/1939 | Crosby | 62/530 |
| 2,334,941 | A | * | 11/1943 | Linden | 62/1 |
| 2,688,467 | A | * | 9/1954 | Leatzow | 62/437 |
| 4,081,024 | A | * | 3/1978 | Rush et al. | 165/62 |
| 4,325,230 | A | * | 4/1982 | Driscoll et al. | 62/293 |
| 4,366,941 | A | * | 1/1983 | Harris | 249/120 |
| 4,554,189 | A | * | 11/1985 | Marshall | 62/530 |
| 4,761,314 | A | * | 8/1988 | Marshall | 62/530 |

OTHER PUBLICATIONS

"Large Cooling Stones" [online], [retrieved on Apr. 11, 2005]. Apr. 13, 2001. Retrieved from the Internet <URL:http://web.archive.org/web/20010413142538/http://www.halfbakery.com/idea/Large__20Cooling__20Stones>.*

"Ice Cube of Sweden" [online], [retrieved on Apr. 11, 2005]. Sep. 28, 2000. Retrieved from the Internet <URL:http://web.archive.org/web/20000928194235/http://www.icecube.se/English/Product.htm>.*

Foley, Ray. Bartending For Dummies. N.Y., Wiley Publishing Inc., 1997. pp. 10–13, 30, 102, 281.*

Vance et al. Large Cooling Stones [online], [retrieved on Aug. 18, 2004]. 2001. Retrieved from the Internet <URL:http://www.halfbakery.com/idea/Large__20Cooling__20Stones>.*

* cited by examiner

*Primary Examiner*—Denise L. Esquivel
*Assistant Examiner*—Richard L. Leung
(74) *Attorney, Agent, or Firm*—Timothy J. Martin; Michael R. Henson; Rebecca A. Gegick

(57) ABSTRACT

A method and a kit is described for cooling beverages. Each employs a naturally occurring, non-porous igneous rock material, such as granite, that may be configured in the form of a polyhedron, such as a cube. The method involves placing one or more masses of the material in a reduced temperature environment for a selected time that may be sufficient to allow the mass to reach equilibrium temperature with the reduced temperature environment. One or more masses are then placed in a vessel along with the beverage to be cooled. The kit houses the masses in a lidded container and one or more vessels are included. A correlation between the size of the masses and the vessels is disclosed.

17 Claims, 1 Drawing Sheet

METHOD AND KIT USED TO COOL BEVERAGES

FIELD OF THE INVENTION

This invention broadly relates to apparatus and methods for cooling beverages. More particularly, the present invention is directed to a kit and method employing thermal cooling materials that do not dilute or contaminate a beverage when placed therein. The invention specifically concerns the use of non-porous igneous rock materials, such as granite, to chill a consumable beverage product.

BACKGROUND OF THE INVENTION

For hundreds of years, people from around the world have enjoyed drinking the noblest of spirits distilled in Scotland. Many Scotch Whiskeys have a fiery temperament that can challenge the bravest palate when drinking it neat (undiluted). The most important properties used to evaluate the quality of Scotch are nose (the smell of the Scotch, mainly to do with aromatics), the palate (the physical feeling of the liquor while held in the mouth) and the finish (what sensations and flavors remain in the mouth after the Scotch is swallowed).

Ice and pure water have been and are still used to tame the fiery spirit of many Scotch Whiskeys. Although these two methods work, they both have serious consequences that connoisseurs of Scotch find objectionable. Ice has two major faults: 1) it will quickly cool the Scotch far below its optimum tasting temperature, and 2) it immediately starts to dilute the Scotch Whiskey. The extreme lowering of the temperature by ice destroys the aromatics, taking away the unique bouquet and flavor characteristics of each Scotch (p. 9 in Scotch Whiskey Top Single Malts by Doug Mclvor, 1998). Excess water, whether put in as ice or as pure water at the ambient room temperature, will affect the concentration of the aromatics (nose) and will affect the feel on the palate and change the finish. Moreover, many of the aromatics are soluble in alcohol so any weakening of the alcohol concentration could cause the oils that flavor Scotch to come out of solution and float on the top of the diluted Scotch and stick to the sides of the glass.

In addition, ordinary tap water, or ice cubes made from tap water, commonly can contain chlorine and other substances that will alter the taste of the whiskey and destroy its aromatics. In some locales, ice cubes may also contain hidden pathogens that can produce illness. Even ice cubes made with pure distilled water can still collect odors and unpleasant flavors from the plastic or metal trays used to make the ice cubes. Also, even using de-ionized and distilled water will change the taste and bouquet of the Scotch Whiskey due to the effects of dilution, and if too cold, will destroy the aromatics. Repeated tests have shown that ice water or ice cubes reduce the temperature of the drink to the freezing point, greatly reducing the complex aromas and grossly altering the taste and finish of the Scotch Whiskey.

The prior art discloses a variety of means to cool beverages using rocks or ice alternatives. All have shown limitations in terms of the possibility of contamination through melting, ingestion of small particles or leakage. For example, glass cubes have been used, but unless special care is taken, glass may contain dangerous sharp shards, which may be injurious to the digestive tract if ingested. An ice alternative as disclosed in U.S. Pat. No. 740,847 to Glebsattel. This patent describes that use of hermetically sealed containers made of glass, porcelain or other suitable material and containing a liquid. These containers are submitted to the freezing process and subsequently used to cool beverages. It is well known that both glass and porcelain chip or break easily. A break in the hermetically sealed container would likely result in leakage of the liquid into the beverage, thereby causing dilution and/or contamination of the beverage.

SUMMARY OF THE INVENTION

It is an object of the present invention to provide a new and useful kit and method that may be employed to reduce the temperature of a beverage to be consumed.

It is another object of the present invention to provide a kit and method of cooling beverages with reduced dilution and contamination.

It is a further object of the present invention to provide a kit and method of cooling beverages in a manor that preserves the flavor of the beverage.

It is still another object of the present invention to provide a kit and method of cooling beverages that reduces the likelihood that additional chemicals, such as those found in tap water, will be introduced into the beverage.

It is still a further object of the present invention to provide a kit and method of cooling beverages that suppresses the vapor pressure of fusel oils, phenols and other bad tasting compounds formed during the fermentation processes used in making many alcoholic beverages, thereby improving the overall taste of the beverage.

According to the present invention, then, the method is disclosed for cooling a quantity of liquid beverage that is to be served at an ambient temperature. Broadly, this method involves the use of at least one mass of material that is in a solid state at a temperature of about 72 degrees F. (about 22.2 degrees C.). This mass of material has a mass volume and, according to the method, is placed for a first interval of time in a selected environment that is at a first temperature less than the ambient temperature at which the beverage is to be served. The method then includes the step of selecting a vessel that has a vessel volume that is at least equal to the mass volume and the quantity of liquid to be cooled. The mass of material is removed from the selected environment after the first interval of time. The method then includes the step of placing in the vessel both mass of material together with the quantity of liquid beverage to be cooled.

In the invention, the mass of material is selected to be a naturally occurring, nonporous igneous rock. Moreover, the mass of material is disclosed to be in the shape of a polyhedron having a plurality of faces, and the polyhedron may be a cube. These faces may be polished. One such nonporous igneous rock substance according to the present invention is granite. Here, also, the mass of material is disclosed to have a heat capacity of about 10.6 calories/degree-mole (the approximate heat capacity of granite).

The step of placing the mass of material together with the liquid beverage in the vessel, on one hand, may be accomplished by first placing the mass of material in the vessel and thereafter placing the liquid beverage in the vessel. Alternatively, this step may be performed by first placing the liquid beverage in the vessel and thereafter placing the mass of material in the vessel. In the later case, the method can also include the step of placing a plurality of masses in the selected environment for the first interval of time. The plurality of masses may be placed in the vessel containing the liquid beverage one at a time thereby to cool the liquid beverage in a controlled manner.

According to the method, the first temperature may be less than about 32° F. (about 0.0° C.). Here, also, it is disclosed that the first temperature is selected to be about 0.0° F. (about −17.0° C.). The first interval of time may be selected in such that the mass of material reaches an equilibrium temperature state with the selected environment. The vessel can have a circular cross-section of a selected diameter and the mass of material is selected to have dimension that is greater than one half the selected diameter.

The present invention also concerns a kit that is adapted to be used to cool liquid beverages. In this aspect of the invention, the kit includes a plurality of masses and material each configured as a polyhedron, such as a cube, and formed of a substance that is nonporous and that is in a solid state at a temperature of about 72° F. (about 22.2° C.). The kit also includes a container forming an enclosure. This container includes a base portion having a plurality of bays each adapted to nestably retain a selected one of the plurality of the masses of material. The kit also includes at least one vessel having a selected maximum cross-sectional dimension. In further detail, the polyhedrons are disclosed to be of a common size and have a maximum dimension that is at least one half of the maximum cross-section dimension of the vessel in the kit. The polyhedrons are shown to be cubes the faces of which are highly polished. The cubes are formed of a nonporous igneous rock substance, such as granite.

These and other objects of the present invention will become more readily appreciated and understood from a consideration of the following detailed description of the exemplary embodiments of the present invention when taken together with the accompanying drawings, in which:

DETAILED DESCRIPTION OF THE EXEMPLARY EMBODIMENTS

Many connoisseurs of Scotch Whiskey like to enjoy the noble liquor of Scotland straight (neat) without anything that would dilute the drink or alter its unique bouquet of taste. The present invention solves the problems of using ice or cold water to tame the fiery properties (the high alcohol content) and some jarring aromas (iodine, fusel oils and excessive amounts of phenol). The kit and method of the present invention employs highly polished masses in the form of cubes or other polyhedrons made of naturally occurring, nonporous igneous rock to carefully lower the temperature 3° to 10° C. or more of a selected beverage. Multiple masses may be used if it is desired to lower the temperature a greater magnitude.

In this way, it is possible to carefully control the temperature of a quantity of beverage. For example, a dram of Scotch Whiskey is able to reach an optimum temperature window for appreciating this liquor. The beauty of this method of cooling the Scotch is that you can enjoy the drink while this process is going on. Because the temperature drop is small and no dilution takes place, very few (if any) of the aromatics are lost. Also significant, is that the slight drop in temperature moderates the fierce burning taste caused by the high alcohol content of Scotch Whiskeys, allowing one to more enjoyably evaluate the complex character of good Scotch. In essence, cooling whiskey with highly polished granite cubes, is a method to broaden the spectrum of smells and tastes used to evaluate the various Scotch Whiskeys made in Scotland or other full-bodied, robust whiskeys distilled in Canada, United States and elsewhere in the world.

Figure 1:
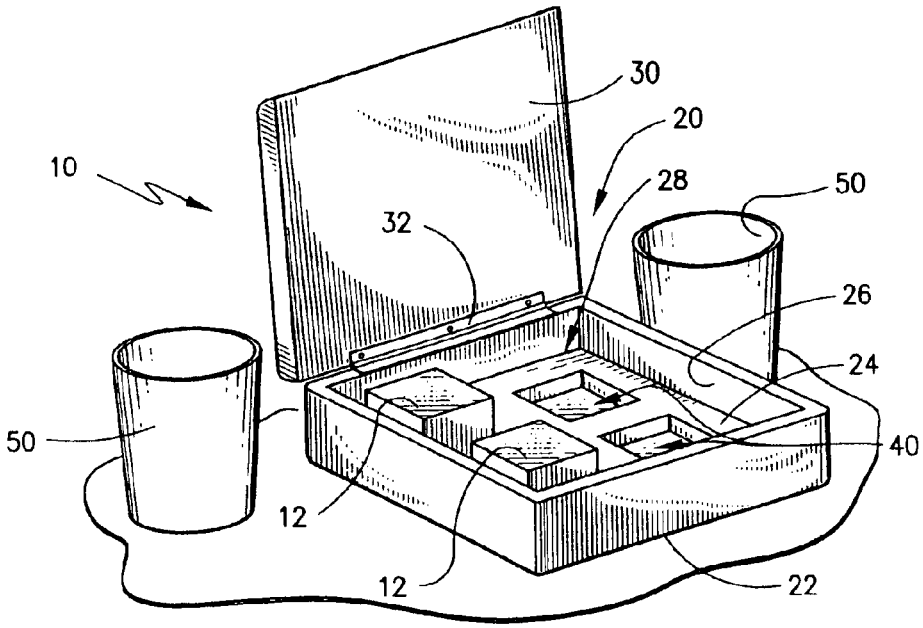
FIG. 1 is a perspective view of a kit according to the exemplary embodiment of the present invention.

With reference, then, to FIG. 1, a kit according to a first exemplary embodiment of the present invention is illustrated. This kit is adapted to be used to cool beverages. Broadly, as is shown in FIG. 1, kit 10 includes a plurality of masses of material 12 each configured as a polyhedron. While FIG. 1 illustrated two such masses 12, it is contemplated that the kit will include four such masses. In any event, the masses of material are formed of a substance that is nonporous and that is in a solid state at a temperature of about 72° F. (about 22.2° C.).

Figure 2:
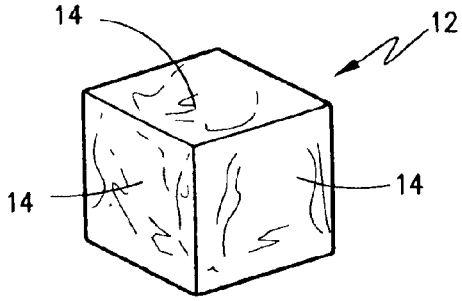
FIG. 2 is a perspective view of a mass of material according to the exemplary embodiment of the present invention shown to be a polyhedron in the form of a cube.

In the embodiment of the kit shown in FIG. 1, the masses of material are configured as cubes, as illustrated in FIG. 2. However, it should be appreciated that other polyhedrons having a different number of faces than six are certainly within the scope of the present invention. In any event, the cubic mass of material 12 as illustrated in FIG. 2 has square shaped faces 14 that are orthogonal to one another. The cube of material 12 is preferably formed of a nonporous igneous rock substance, such as granite. In such event, it is desired that each of faces 14 be highly polished. The material used to form mass 12 should be nonporous so as not to impart any unwanted flavors to the beverage to be cooled. Moreover, they can readily absorb undesirable smells and liquids that will contaminate the Scotch Whiskey.

Rocks for the granite cubes can be made from high quality granite (with a very low porosity) found in Scotland and all over the world. These granite materials come in many colors and grain sizes, but the more common colors are white, black, red and green. Slabs of granite five feet by ten feet by 30 mm can be purchased from granite dealers. These smaller slabs are then cut unto cubes and all six sides are polished to a mirror finish. Depending on the quality of the diamond blades used to cut the granite, the number of steps required to polish the granite can vary. Normally five (5) sizes of diamond or corundum grit are used when polishing granite cubes.

The highly polished granite cubes have nominal dimensions of 1.05 inches by 1.05 inches by 1.05 inches (but may be as small as 0.5 inches and as large as 2 inches). The attributes of the highly polished granite cubes cannot be too small as there would be a danger of possibly swallowing one during use and choking. If they are much larger than 1.05 inches, the size may become too unwieldy and impractical for use in normal whiskey drinking glasses.

With reference again to FIG. 1, it may be seen that kit 10 further includes a container 20 here illustrated as a box including a base portion 22 having a bottom 24 and an upstanding sidewall 26 extending therearound to form an open interior 28. A lid 30 is attached to one edge of base portion 22 and is pivotally secured thereto by means of a hinge 32. Lid 30 may then pivot between a closed position wherein it abuts the upper rim of sidewall 26 and an open position as is illustrated in FIG. 1.

Bottom 24 of base portion 22 includes a plurality of bays, such as bays 40 which are each adapted to nestably retain a selected one of the plurality of masses of material. In FIG. 1, it may be seen that bays 40 are square shaped in configuration and are sized for close fitted, snug nesting of a mass 12 therein. It should be understood that, in the embodiment illustrated in FIG. 4, there are four such bays. Two of these bays 40 are shown as empty while the other two bays are receiving a pair of masses of material 12. Accordingly, four such masses of material are contemplated.

Figure 3:
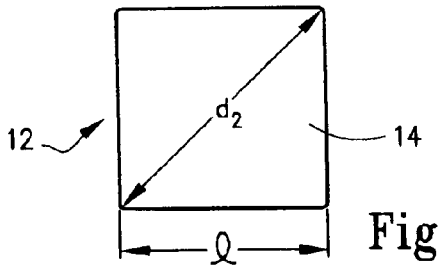
FIG. 3 is a diagrammatic view showing the dimensions of one face of the cube shown in FIG. 2.

The kit according to the disclosed embodiment includes at least one, but preferably two vessels 50 which are adapted to receive the beverage to be cooled along with a single of mass material 12. To this end, it may be seen that each vessel 50 is in the form of a glass that is a slightly tapering cylinder having a diameter "$d_1$". With reference to FIG. 3, it may be seen that a face 14 of the cubic mass of material 12 has an edge length "I" so that it has a diagonal "$d_2$" that is equal to 12. Thus, the maximum dimension of a cubic mass of material 12, such as that shown in FIG. 14, extending from corner to corner equals 13. The embodiment shown is desired that its maximum dimension 13 be at least one half the maximum cross-section dimension "$d_1$" of vessel 50.

Figure 4:
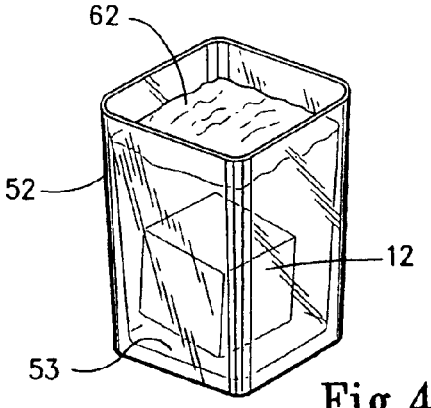
FIG. 4 is a perspective view showing the mass of material of FIG. 2 placed with a liquid beverage in a vessel of a first configuration.
Figure 5:
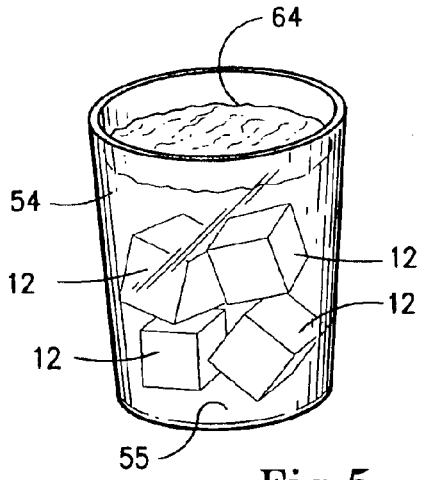
FIG. 5 is a perspective view showing a plurality of cubes, such as those shown in FIG. 2, placed together with a liquid beverage in a second vessel of a different size than that shown in FIG. 4.

FIGS. 4 and 5 depict the use of one or more masses of material 12 in representative vessels 52 and 54. In FIG. 4, vessel 52 is shown to receive a quantity 62 of a beverage to be cooled along with a single cube 12 of highly polished granite according to the present invention. It may be seen that vessel 52 of the kit 10 is configured such that only a single cube 12 can contact the bottom 53 of vessel 52. However, as is illustrated in FIG. 5, a vessel 54 can be used. Here, vessel 54 is of larger capacity and receives a quantity 64 of a selected beverage to be cooled. Here, however, vessel 54 is of sufficient size to receive a plurality of masses 12 with two such masses contacted bottom 55 of vessel 54.

From the foregoing, it should be understood that the present invention is directed to a method for cooling a quantity of liquid beverage that is to be served at an ambient temperature. Such ambient temperature may well be room temperature, as would typically be the case. In the method, at least one mass of material having a mass volume is placed in a selected environment that is at a first temperature that is less than the ambient temperature at which the beverage is to be served. This mass of material is selected from a material that is in a solid state at a temperature of about 72° F. (about 22.2° C.). The mass of material is left at the first temperature for a first interval of time. The method then includes the step of selecting a vessel that has a vessel volume at least equal to the mass volume and the quantity of liquid to be cooled. After the first interval of time, the mass of material is removed from the selected environment. The mass of material and the quantity of liquid beverage are then placed together in the vessel so that the beverage may be consumed.

In this method, the mass material is the nonporous igneous rock substance, such as granite. In any event, the mass material is selected to be nonporous. The mass may be in the shape of a polyhedron having faces. One example of such a polyhedron is a cube, but it should be appreciated that other shaped polyhedrons are within the scope of this invention. When the mass material is granite, the faces of the polyhedron are polished. Naturally, other shaped polyhedrons having polished faces would again be within the scope of this method.

The step of placing the mass material together with the liquid beverage in the vessel can be accomplished in two alternative ways. On one hand, it may be accomplished by first placing the mass of material in the vessel and thereafter placing the liquid beverage in the vessel. Alternatively, the liquid beverage may be first placed in the vessel and thereafter a mass material may be placed in the vessel. Here, also, a plurality of masses of material can be placed in the selected environment for the first interval. A plurality of masses may be placed in the vessel containing the liquid beverage, with this process being conducted such that the masses of material are placed one at a time thereby to cool the liquid beverage in a controlled manner.

According to the method described, the first temperature of the selected environment may be less than about 32° F. (about 0.00° C.). Moreover, according to the present invention, it is contemplated that the first temperature be about that of available in a freezer so that the first temperature is about 0.0° F. (about −17.0° C.). When highly polished granite cubes are used according to the method of the present invention and these cubes are cooled in a household freezer (to approximately−17 Centigrade), they will not lower the temperature of any two or three ounce beverage to the freezing point of water, as will ice. Thus the use of such cubes will preserve the complexities of aroma, palate and finish inherent in the Scotch Whiskey. Furthermore, since Scotch Whiskey is made from water that has percolated through the extremely hard, primordial granites of Scotland, any material dissolving from the cubes would be of the same chemical nature as found in the Scotch Whiskey. This means there would be a negligible change in the flavor.

Also, if desired, the method contemplates having a vessel that is circular in cross-section with the circular cross-section having a selected diameter. According to this aspect of the method, the mass is selected to have dimension that is at least one half the selected diameter. According to the method, also, the first interval of time may be selected such that the mass of material reaches an equilibrium temperature state with the selected environment prior to being placed in the vessel. The mass of material may have a heat capacity of about 10.6 calories/degree-mole, which corresponds to the heat capacity of silicon dioxide $SiO_2$ which is a major constituent of granite.

Accordingly, it should be appreciated that the present invention provides numerous advantageous features, including:

a) The highly polished granite cubes can be used to cool or heat any beverage without causing dilution;

b) The very hard, durable, and highly polished granite cubes will not impart to any drink obnoxious odors or undesirable foreign substances such as chlorine or ozone common in drinking water;

c) The highly polished granite cubes will not add any noticeable flavor or bouquet to any beverage;

d) The highly polished granite cubes, when cooled in a household freezer (to approximately −17 Centigrade), will not lower the temperature of any 2 or 3 ounce beverage to the freezing point of water like ice will;

e) The highly polished granite cubes will only lower the temperature of the beverage a limited amount, without destroying the aromatics, thus allowing one to appreciate the broad spectrum of tastes found in the drink;

f) As the temperature slightly drops, the aroma, taste and palate will gently change, opening up a new window to assist one in exploring the vast complexities of aroma, palate and finish when drinking fine beverages such as Scotch Whiskey;

g) The highly polished granite cubes will lower the temperature of the Scotch Whiskey from typical room temperature to the ambient temperature of 17th Century, non-centrally-heated Scotland, which is the ideal temperature for appreciating the drink; and h) The highly polished granite cubes can be used to lower temperature of the beverage in a controlled way, by adding the cooled granite cubes one by one.

In one exemplary embodiment of the invention, highly polished granite cubes, described above, are used as follows:

a) A number of granite cubes are placed in a suitable container in a freezer that has an internal temperature of approximately −17° Centigrade (0° Fahrenheit) for several hours to allow sufficient time for the freezer to completely chill the granite cubes.

b) Depending on the desired temperature drop, one or two cold cubes are gently placed, preferably with tongs, in a dram glass, tasting glass or whiskey tumbler. Handling the granite cubes with fingers is discouraged because fingers will warm up the cubes and fingers may be covered with body oils and food contaminants etc. that should not be mixed in with the beverage.

c) Next, one to three ounces of Scotch Whiskey (or other beverage) is carefully added to the glass.

d) The drink should then be slowly swirled around for about thirty seconds. The drink should not be shaken. The drink will quickly begin to cool, and a new way of appreciating Scotch Whiskey can begin.

e) Before the last sip is taken, the granite cubes may be removed with tongs; the cubes are designed to be of such a size that the average person may not easily ingest the cubes.

f) If the used cubes are dried, and placed in the container from where they were taken, they need not be washed. The high alcohol concentration in the Scotch Whiskey is a natural disinfectant. Only use a lint-free cloth to wipe away any excess drink found on the used granite cubes.

g) It is highly recommended that the granite cubes never be washed in a dishwasher as the harsh detergents can damage the highly polished surfaces found on the cubes.

h) The highly polished granite cubes should never be washed with soap. If necessary, the cubes can be cleaned with pure grain alcohol and dried with a lint-free cloth.

Accordingly, the present invention has been described with some degree of particularity directed to the exemplary embodiments of the present invention. It should be appreciated, though, that the present invention is defined by the following claims construed in light of the prior art so that modifications or changes may be made to the exemplary embodiments of the present invention without departing from the inventive concepts contained herein.

We claim:

1. A method for cooling a quantity of a liquid beverage that is to be served at an ambient temperature, comprising:

(A) placing at least one mass of nonporous igneous rock having a mass volume and that is in a solid state at a temperature of about 72° F. (about 22.2° C) in a selected environment that is at a first temperature that is less than the ambient temperature at which the beverage is to be served for a first interval of time;

(B) selecting a vessel that has a vessel volume at least equal to the mass volume and the quantity of liquid to be cooled;

(C) removing the mass of material from the selected environment after the first interval of time; and (D) placing the mass of material together with the quantity of the liquid beverage in said vessel.

2. A method according to claim 1 wherein said mass is granite.

3. A method according to claim 1 wherein said mass is in the shape of a polyhedron having faces.

4. A method according to claim 3 wherein said polyhedron is a cube.

5. A method according to claim 3 wherein said mass is granite and wherein a plurality of the faces of said polyhedron are polished.

6. A method according to claim 1 wherein the step of placing the mass of material together with the liquid beverage is accomplished by first placing the mass of material in said vessel and thereafter placing the liquid beverage in said vessel.

7. A method according to claim 1 wherein the step of placing the mass of material together with the liquid beverage is accomplished by first placing the liquid beverage in said vessel and thereafter placing the mass of material in said vessel.

8. A method according to claim 7 wherein a plurality of masses of material are placed in the selected environment for the first interval of time and wherein the plurality of masses is placed in said vessel containing the liquid beverage one at a time thereby to cool the liquid beverage in a controlled manner.

9. A method according to claim 1 wherein the first temperature is less than about 32° F. (about 0.0° C.).

10. A method according to claim 9 wherein the first temperature is about 0.0° F. (about −17.0° C.).

11. A method according to claim 1 wherein the vessel has a circular cross-section of a selected diameter and wherein said mass is selected to have a dimension that is greater than one-half the selected diameter.

12. A method according to claim 1 wherein the first interval of time is such that the mass of material reaches an equilibrium temperature state with the selected environment.

13. A method according to claim 1 wherein said mass of material has a heat capacity of about 10.6 calories/degree-mole.

14. A method for cooling a quantity of and alcoholic beverage selected from a group consisting of scotch and whiskey that is to be served in an environment that is at an ambient temperature, comprising:

(A) placing at least one mass of nonporous igneous rock having a mass volume and that is in a solid state at a temperature of about 72° F. (about 22.2° C.) in a selected environment that is at a first temperature that is less than the ambient temperature at which the beverage is to be served for a first interval of time;

(B) selecting a vessel that has a vessel volume at least equal to the mass volume and the quantity of liquid to be cooled;

(C) removing the mass of material from the selected environment after the first interval of time; and (D) placing the mass of material together with the quantity of the liquid beverage in said vessel.

15. A kit adapted to be used to cool liquid beverages, comprising:

(A) a plurality of masses of nonporous igneous rock each said mass configured as a polyhedron having substantially the same size and shape;

(B) a container having an interior and forming an enclosure and including a base portion having a plurality of bays each adapted to nestably retain a selected one of said plurality of masses of material; and (C) a vessel having a selected maximum cross-sectional dimension, said masses each having a maximum dimension that is at least one-half of the maximum cross-sectional dimension of said vessel.

16. A kit according to claim 15 wherein each of said masses is granite.

17. A kit according to claim 15 further including a lid sized and adapted to cover said container.

* * * * *